US006719584B1

(12) United States Patent
Favro et al.

(10) Patent No.: US 6,719,584 B1
(45) Date of Patent: Apr. 13, 2004

(54) WATERTIGHT FLEXIBLE CONNECTOR

(75) Inventors: Matthew Novak Favro, Rochester, NY (US); Michael David Stevens, Avon, NY (US); Brent Eric Raiber, West Henrietta, NY (US); Robert George Bray, Webster, NY (US)

(73) Assignee: Harris Corporation, Melbourne, FL (US)

( * ) Notice: Subject to any disclaimer, the term of this patent is extended or adjusted under 35 U.S.C. 154(b) by 2 days.

(21) Appl. No.: 10/271,541

(22) Filed: Oct. 17, 2002

(51) Int. Cl.[7] ..... H01R 12/24
(52) U.S. Cl. ..... 439/499
(58) Field of Search ..... 439/499, 587, 439/364, 589, 595, 404, 498, 493

(56) References Cited

U.S. PATENT DOCUMENTS 3,999,826 A * 12/1976 Yurtin ..... 439/495
4,526,432 A * 7/1985 Cronin et al. ..... 439/320
4,740,867 A * 4/1988 Roberts et al. ..... 361/749
4,950,170 A * 8/1990 Miller, Jr. ..... 439/74
5,194,010 A * 3/1993 Dambach et al. ..... 439/79
6,007,377 A * 12/1999 Cook ..... 439/587
6,039,596 A * 3/2000 Whiteman et al. ..... 439/404
6,334,250 B1 * 1/2002 Maeda et al. ..... 29/857
6,364,695 B1 * 4/2002 Watanabe ..... 439/498

* cited by examiner

*Primary Examiner*—Jean F. Duverne
(74) *Attorney, Agent, or Firm*—Duane Morris LLP

(57) ABSTRACT

A watertight connector assembly includes a flat, flexible electrical cable completely encased in an elastomer coating, except at predetermined access openings configured to provide access to the cable. The access openings are defined by O-ring type seals formed in the coating on the surfaces of the cable near each end of the cable. Strain reliefs are positioned within the O-ring type seals. Electrical connectors are positioned within the access openings and configured to provide electrical coupling to the cable and to an external device. Compression pads are positioned adjacent the cable opposite the side of the cable having the electrical connector positioned adjacent thereto. This connector assembly is capable of withstanding harsh environments in compliance with environmental and vibration military specifications.

13 Claims, 8 Drawing Sheets

WATERTIGHT FLEXIBLE CONNECTOR

BACKGROUND

The present invention is generally related to radios, and more specifically related to software-defined radios. Electronic equipment used in military applications, such as hand held radios for example, is often subjected to harsh vibration and environmental conditions. Such conditions include extreme temperature fluctuations, excessive moisture, and excessive vibration due to motion of a vehicle or handling of the equipment. These conditions can adversely affect the performance of the equipment. For example, moisture can cause short circuits and corrosion. Temperature variations can cause components to shrink and expand resulting in electrical circuits becoming disconnected or causing intermittent open circuits. Vibration can also cause disconnected circuits or components to fail.

To ensure proper operation of this electronic equipment, components within the electronic equipment must be designed to withstand harsh vibration and environmental conditions. It is often advantageous if the components are small, light weight, and easily configured to fit within the contours of the equipment. Such components typically include various electronic circuits having electrical connectors. Furthermore, it may be desirable to electrically couple a circuit in a first component with a circuit in a second component where the first and second components comprise separate watertight containers. Thus a need exists for a watertight electrical connector capable of withstanding the above-described harsh conditions. The electrical coupling can be achieved via a flexible watertight electrical connector assembly that is capable of electrically connecting at one end one or more circuits in the first component and electrically connecting at the other end to one or more circuits in the second component while maintaining the watertight integrity of the first and second components. This type of flexible watertight electrical coupling is particularly applicable to hand held military radios.

A flexible watertight connector assembly includes a flexible cable encased in an elastomer coating defining a plurality of openings, each opening configured to provide access to the cable. The connector assembly includes at least one electrical connector, each one of the connectors positioned adjacent the cable within a respective one of the plurality of openings. Each electrical connector is configured to be electrically coupled to the cable. The connector assembly also includes at least one pair of covers comprising a first type cover and a second type cover. Each cover is positioned adjacent a respective one of the plurality of openings. Each cover is configured to form a watertight seal with the elastomer coating defining a respective opening. Each first type cover is configured to cover an opening having an electrical connector positioned therein, and each first type cover and a respective electrical connector are configured to form a watertight seal.

DETAILED DESCRIPTIONS

Figure 1:
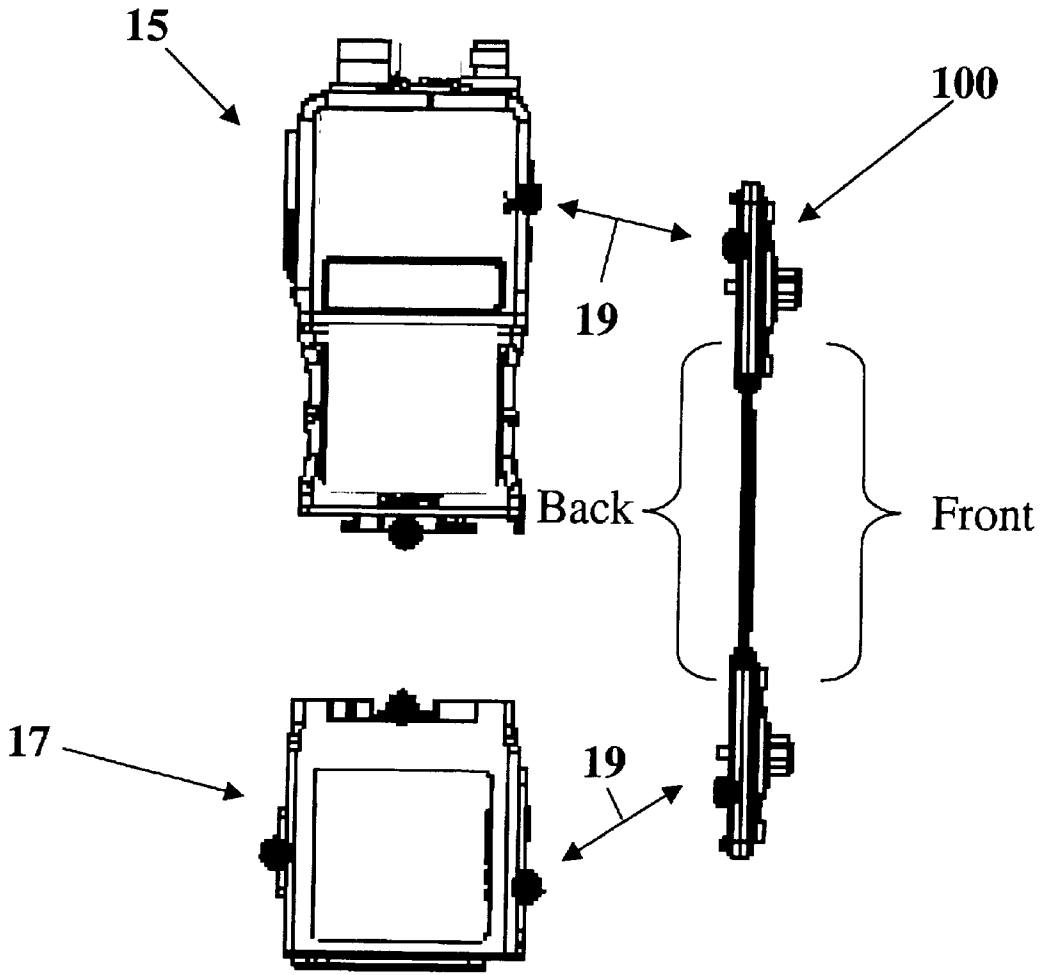
FIG. 1 is an illustration of a watertight connector assembly in accordance with the present invention used to couple a handheld radio and a powerblock assembly.

One embodiment of a watertight flexible electrical connector assembly, as described in more detail herein, includes a flat flexible electrical cable encased in an elastomer coating. The coating completely encases the cable except for a predetermined number of access openings configured to provide access to the cable. The access openings are defined by O-ring type seals formed in the coating on the surfaces of the cable near each end of the cable. When assembled, the seals mate with front and rear covers to form a watertight seal for preventing intrusion of water into the connector assembly and to provide vibration absorption. The coating includes strain reliefs positioned within the O-ring type seals (e.g., to provide strain relief from handling of the connector assembly and excessive vibration). The assembly also includes electrical connectors positioned within the access openings and configured to provide electrical coupling to the cable and to an external device (i.e., external to the connector assembly). The electrical connectors include an array of electrical contacts formed in an elastomer base. The elastomer base is configured to provide watertight integrity around the individual electrical contacts, to provide watertight integrity with the mating surfaces of the electrical connector and its respective cover, and to provide vibration absorption. The connector assembly includes compression pads positioned adjacent the cable opposite the side of the cable having the electrical connector positioned adjacent thereto. The compression pads provide vibration absorption and watertight integrity, and ensure electrical coupling between the electrical contacts and the cable. This connector assembly is configured to withstand harsh environments in compliance with environmental and vibration military specifications.

In this description, relative terms such as "horizontal," "vertical," "up," "down," "top," "bottom," "back," and "front" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Referring now to FIG. 1, there is shown a connector assembly 100 in accordance with the present invention used to couple a handheld radio 15 and a powerblock assembly 17. As shown in FIG. 1, the connector assembly 100 is in an assembled configuration. The depiction of handheld radio 15 being coupled to powerblock assembly 17 by the connector assembly 100 is exemplary. The connector assembly 100 may be used to couple any appropriate external devices. The arrows 19 indicate locations at which the connector assembly 100 may be connected to the handheld radio 15 and the powerblock assembly 17. The connector assembly 100 provides means for electrical signals to be coupled between devices (e.g., the powerblock assembly 17 and the handheld radio 15) coupled to the connector assembly 100. The designation of front side and back side of the connector assembly 100, as shown in FIG. 1, will be used throughout this description.

Figure 2:
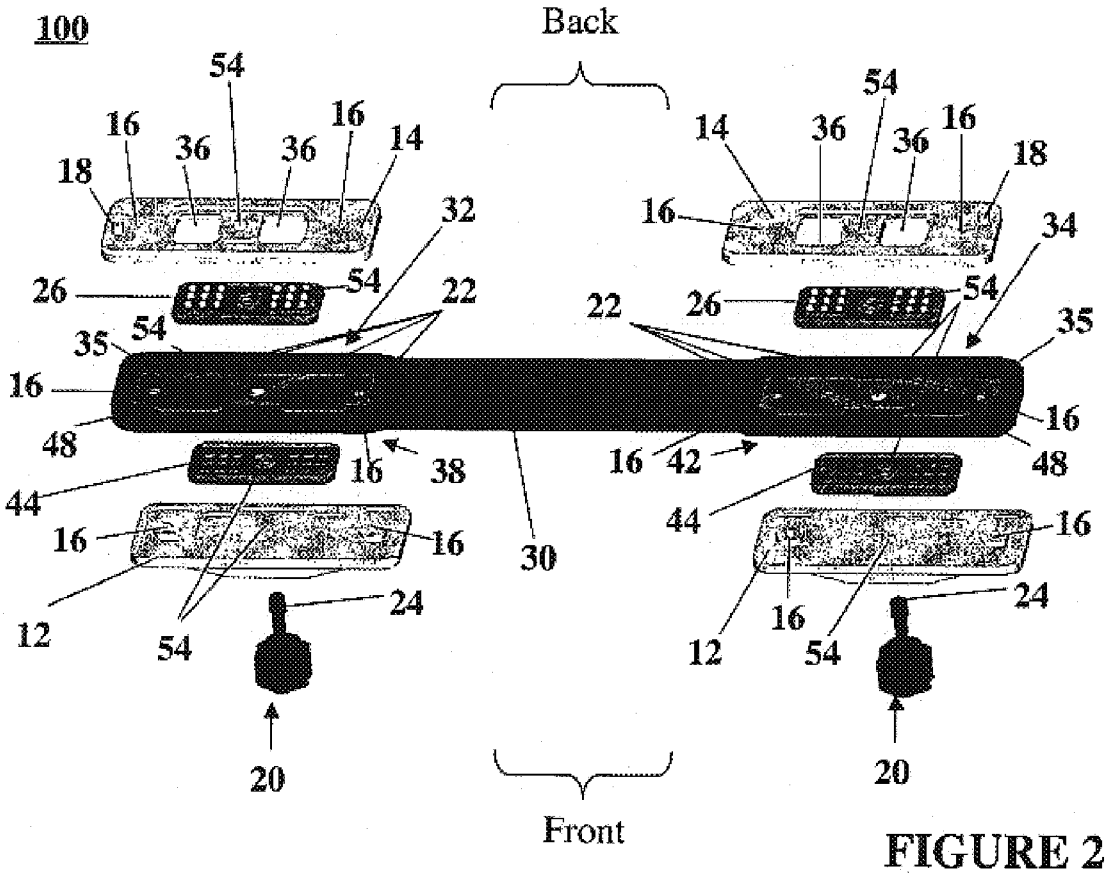
FIG. 2 is an expanded view of the connector assembly showing the back side up.
Figure 3:
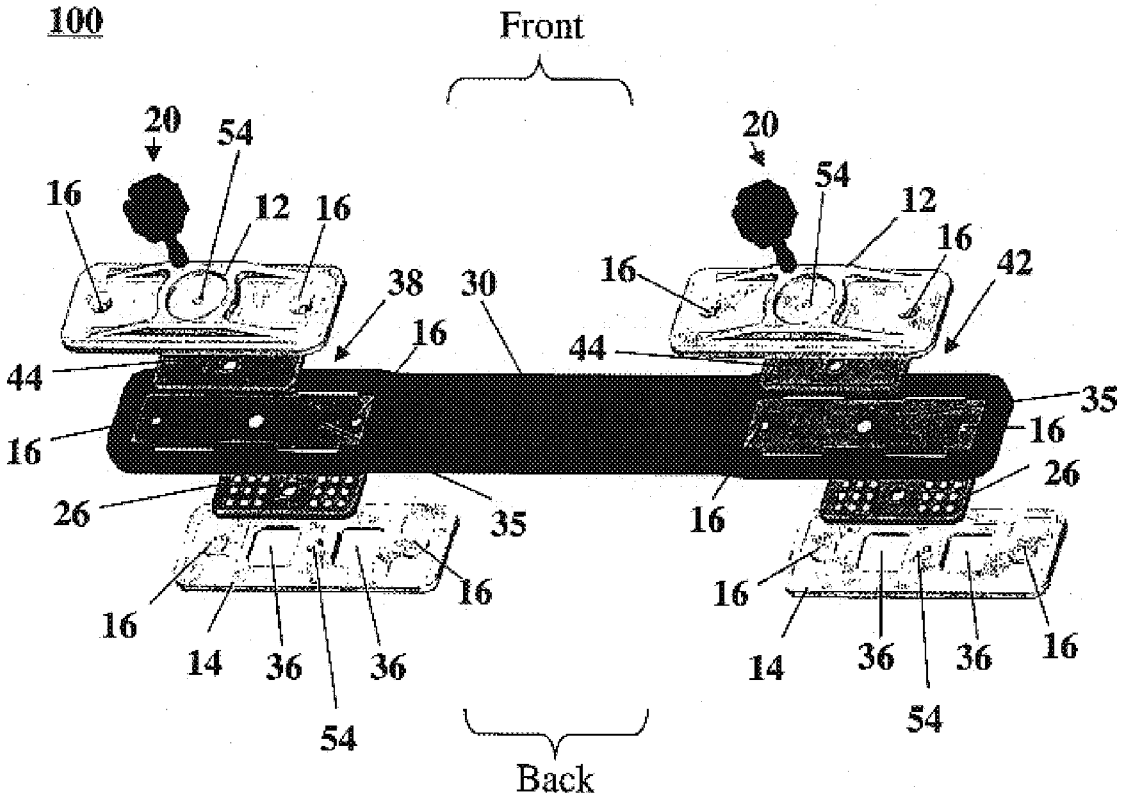
FIG. 3 is another expanded view of the connector assembly showing the front side up.
Figure 4:
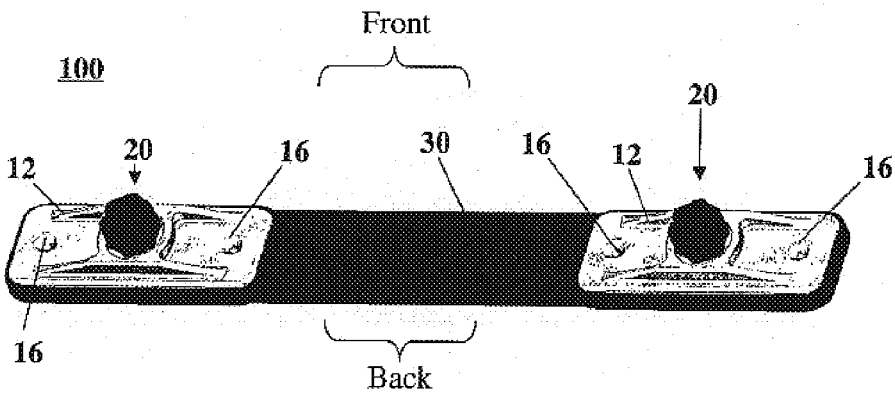
FIG. 4 is an illustration of an assembled connector assembly in accordance with the present invention showing the front side up.
Figure 5:
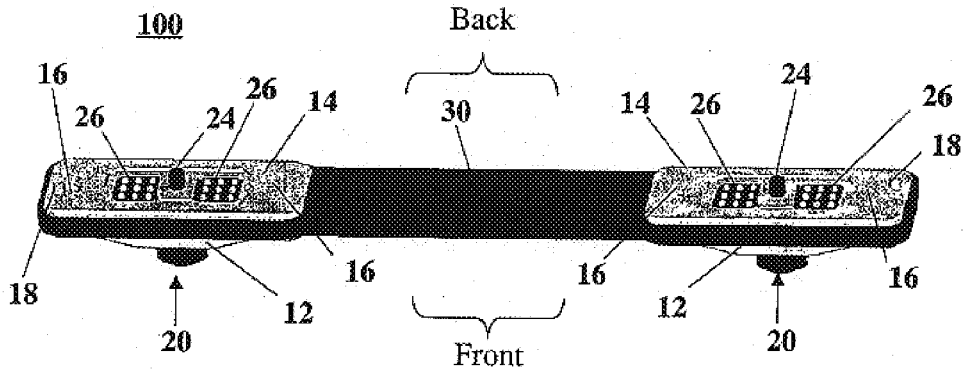
FIG. 5 is another illustration of an assembled connector assembly showing the back side up.

FIGS. 2 and 3 are expanded views of the connector assembly 100 showing back side up and front side up, respectively. FIGS. 4 and 5 are assembled views of the connector assembly 100 showing front side up and back side up, respectively. Referring to FIGS. 2, 3, 4, and 5, the connector assembly 100 includes front covers 12, back covers 14, electrical connectors 26, compression pads 44, external device fasteners 20 depicted as thumb screws, and a flexible cable 35 encased in an elastomer coating 30. In one embodiment of the connector assembly 100, the flexible cable 35 is a flat, flexible cable providing electrical coupling between the ends of the flexible cable 35. The elastomer coating 30 may comprise any appropriate material providing elastic properties, such as urethane or silicone, for example. The cable 35 is completely encased by the elastomer coating 30 except at predetermined access openings. The elastomer coating 30 defines access openings 32, 34, 38, and 42. The access openings 32, 34, 38, and 42 are defined by respective raised edges 48. Raised edges 48 arc in the form of an O-ring type seal surrounding the perimeter of each opening 32, 34, 38, and 42. In one embodiment, the O-ring type seal is positioned in the bottom of the recessed groove 50 (not shown in Figures), and the raised edge 48 is positioned external to the mounting covers to facilitate the elimination of the gap between respective covers. The access opening 32 and 38 are positioned on opposing back and front sides, respectively, of the connector assembly 100. The access opening 34 and 42 are positioned on opposing back and front sides, respectively, of the connector assembly 100. The access openings 32, 34, 38, and 42 provide access to the flexible cable 35. The locations of the access openings 32, 34, 38, and 42 are exemplary. More or less access opening may be formed. The location of the access openings may also differ from the locations shown in FIG. 2. For example, a connector assembly in accordance with the present invention may have one end hardwired to an external device and the other end may be detachable. In this configuration, the connector assembly would include two opposing access openings respectively located on the front and back sides of the connector assembly. In another embodiment, a connector assembly in accordance with the present invention may comprise three connection sites (for example, for coupling three external devices to each other). This embodiment would comprise six access openings, configured as three opposing pairs of access openings respectively located on the back and front sides of the connector assembly.

At each end of the connector assembly 100, respective front covers 12 and back covers 14 are fastened together by an appropriate assembly fastener (assembly fastener now shown) inserted into fastening openings 16. Each of the front covers 12, the back covers 14, and the cable 35 define a respective pair of fastening openings 16. The number of fastening openings is exemplary and may be increased or decreased. Examples of appropriate assembly fasteners to be inserted into fastening openings 16 include threaded fasteners, such as Phillips head and flat head screws, riveted fasteners, or a combination thereof. Each back cover 14 defines at least one back cover access opening 36. As described in more detail below, each back cover access opening 36 is configured to conformably mate with a respective electrical connector 26.

In an alternate embodiment, the front covers 12 do not comprise fastening openings 16. Rather, the front cover 12 comprises a boss like structure protruding from the surface of the front cover 12 adjacent the cable 35 positioned in the where the fastening openings 16 would be positioned. The boss like structure does not form an opening. In this embodiment, a fastener is inserted through the fastener opening 16 on the back cover 14 and threadabley received by the boss like structure. The boss like structure facilitated the prevention of water intrusion into the cable assembly 100.

The external device fasteners 20, depicted as thumbscrews facilitate the fastening of the connector assembly 100 to an external device. Each thumbscrew 20 comprises a threaded portion 24, which is inserted through the central openings 54 and threadably attached to a respective external device. In one embodiment, the central opening 54 of each front cover 12 comprises threads for receiving the threaded portion 24 of a thumbscrew 20, and for preventing the thumbscrew 20 from becoming inadvertently detached from the connector assembly 100. In this embodiment, the remainder of the central openings 54 (e.g., defined by compression pad 44, cable 35, electrical connector 26, and back cover 14) do not contain threads, allowing the threaded portion 24 of the thumbscrew 20 to slide through these remainder of central openings. In one embodiment, the thumbscrew is recessed on the underside of the head to accommodate an O-ring type seal to provide a water resistant seal around the central opening 54. Guide pins 18 facilitate the positioning of each end of the connector assembly 100 on each respective external device and help prevent rotation of the connector assembly 100 when it is attached to a respective external device. In one embodiment, a seal (e.g., O-ring type seal) is positioned around the perimeter of each back cover 14 on the surface of the back cover that mates with the external device. This seal facilitates the provision of watertight integrity between the connector assembly 100 and an external device. As previously described, in one embodiment, an O-ring type seal is positioned in the bottom of the recessed groove 50, and the raised edge 48 is positioned external to the mounting covers to facilitate the elimination of the gap between respective covers.

Figure 6A:
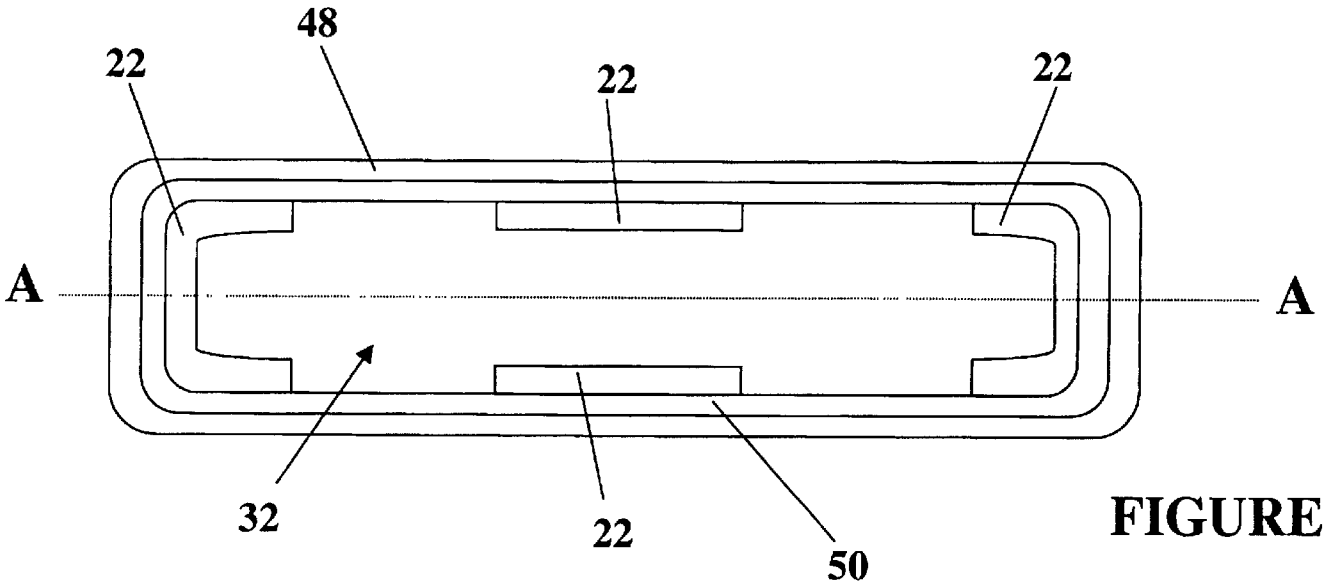
FIG. 6A is a planar view of an access opening formed in an elastomer coating in accordance with an embodiment of the present invention, illustrating strain reliefs, raised edge, and the recessed groove.
Figure 6B:
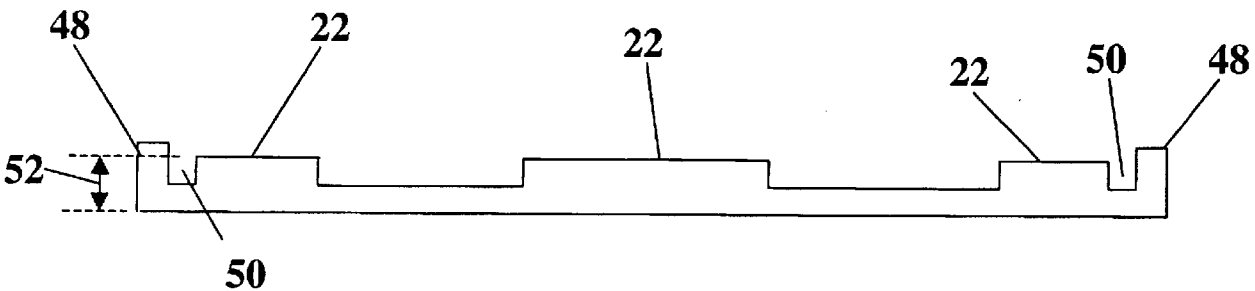
FIG. 6B is a cross-sectional view of the access opening shown in FIG. 6A.

FIG. 6A is a planar view of the access opening 32 illustrating strain reliefs 22, raised edge 48, and recessed groove 50. FIG. 6B is a cross-sectional view of the access opening 32 at line A—A. Each access opening 32, 34, 38, and 42 is formed by a raised edge 22 in the elastomer coating 30 and has positioned therein strain reliefs 22. Strain reliefs 22 provide relief from strain placed on the connector assembly from handling by a user and from vibration. Recess groove 50 is formed between raised edge 48 and strain reliefs 22. The recessed groove 50 is configured to receive a protruding edge of a respective cover (e.g., back cover 14 for access opening 38) when the connector assembly 100 is assembled. The strain reliefs 22 are raised to a level between the recessed groove 50 and the raised edge 48, as indicated by arrow 52 in FIG. 3B. As described in greater detail below, when the back cover 14 is positioned over the access opening 32, the assembled connector assembly 100 provides a water tight seal formed by the mating of the raised edge 48 with an inner surface of the back cover 14 and the mating of the recessed groove 50 with the protruding edge of the back cover 14. Similarly, the connector assembly 100 provides a watertight seal formed by the mating of each access opening with its respective cover.

Figure 7:
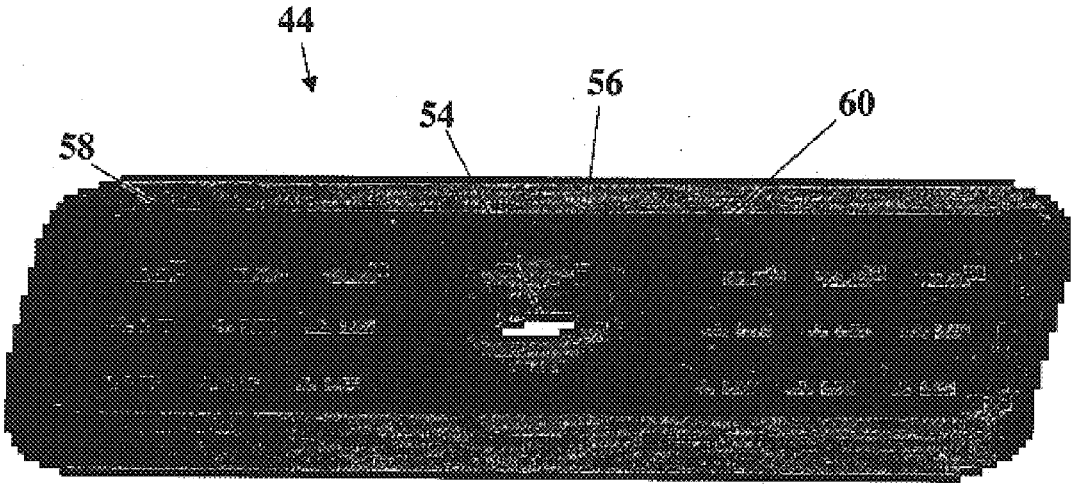
FIG. 7 is an illustration of a compression pad in accordance with an embodiment of the present invention.

FIG. 7 is an illustration of a compression pad 44. Each compression pad 44 defines a central opening 54 and comprises a compression pad raised edge 58, a central opening raised edge 56, and a recessed region 60. The compression pad 44 is formed of a material having elastic properties, such as the elastomer materials urethane or silicone, for example. The compression pad raised edge 58 is formed around the perimeter of the compression pad 44. The central opening raised edge 56 if formed around the perimeter of the central opening 54. The raised edges 56, 58, are formed on both sides of the compression pad 44. Each of the raised edges 56, 58, facilitate the formation of a watertight seal when the connector assembly 100 is assembled. When the connector assembly 100 is assembled, the compression pad raised edge 58 on one side of the compression pad 44 mates with a respective front cover 12 to form a watertight seal therebetween. The compression pad raised edge 58 on the other side of the compression pad 44 mates with the flexible cable 35 also to provide a watertight seal therebetween. Similarly, the central opening raised edge 56 on one side of the compression pad 44 mates with a respective front cover 12 at the perimeter of the front cover's central opening 54 to form a watertight seal therebetween. The central opening raised edge 56 on the other side of the compression pad 44 mates with the flexible cable 35 also to provide a watertight seal therebetween. Furthermore, in one embodiment, raised pad like portions on the front and back surfaces of the compression pad 44 provide a spring like force against the flexible cable 35 to facilitate the electrical connection between the flexible cable 35 and a respective electrical connector 26. The recessed region 60 may be formed to include appropriate surface contours to also facilitate an electrical connection between a respective electrical connector 26 and the flexible cable 35.

Figure 8A:
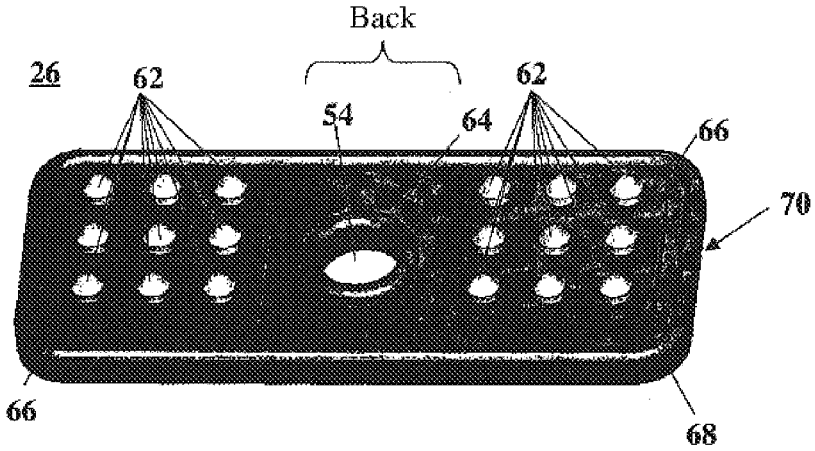
FIG. 8A is an illustration a back view of an electrical connector in accordance with an embodiment of the present invention.
Figure 8B:
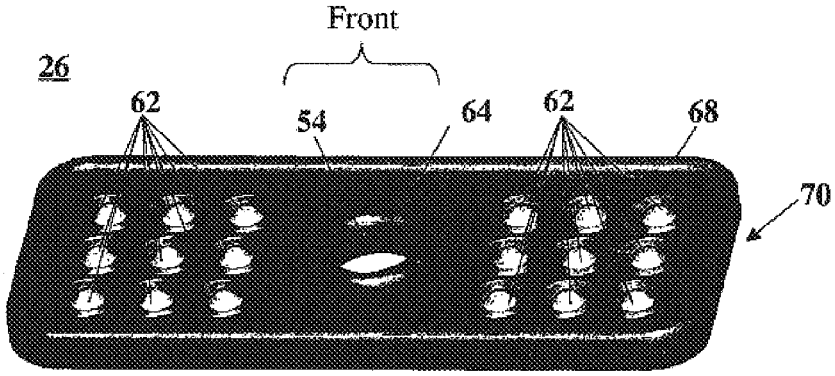
FIG. 8B is an illustration a front view the electrical connector shown in FIG. 8A.

FIGS. 8A and 8B illustrate a back view and a front view, respectively, of the electrical connector 26. Each electrical connector 26 comprises a base portion 70 defining a respective central opening 54. The base portion 70 is formed of a material having elastic properties, such as the elastomer materials urethane or silicone, for example. The base portion 70 has positioned therein, a plurality of electrical contacts 62. The base portion 70 is formed to include an electrical connector raised edge 68, a base central opening raised edge 64, and a raised portion 66. The base portion raised edge 68 is formed around the perimeter of the base portion 70. The base central opening raised edge 64 is formed around the perimeter of the central opening 54. The raised edges 64, 68, are formed on both sides (front and back) of the base portion 70. Each of the raised edges 64, 68, facilitate the formation of a watertight seal when the connector assembly 100 is assembled. When the connector assembly 100 is assembled, the base portion raised edge 68 on the back side of the electrical connector 26 mates with a respective back cover 14 to form a watertight seal therebetween. The raised portion 66 is configured to conform to the shape of the back cover access openings 36. The base portion raised edge 68 on the front side of the electrical connector 26 mates with the flexible cable 35 also to provide a watertight seal therebetween. Similarly, the base central opening raised edge 64 on the back side of the base portion 70 mates with a respective back cover 14 at the perimeter of the back cover's central opening 54 to form a watertight seal therebetween. The base central opening raised edge 64 on the front side of the electrical connector 26 mates with the flexible cable 35 also to provide a watertight seal therebetween. In an alternate embodiment, the base portion 70 comprises raised portions 66 on both the front and back sides of the electrical connector 26.

Figure 9:
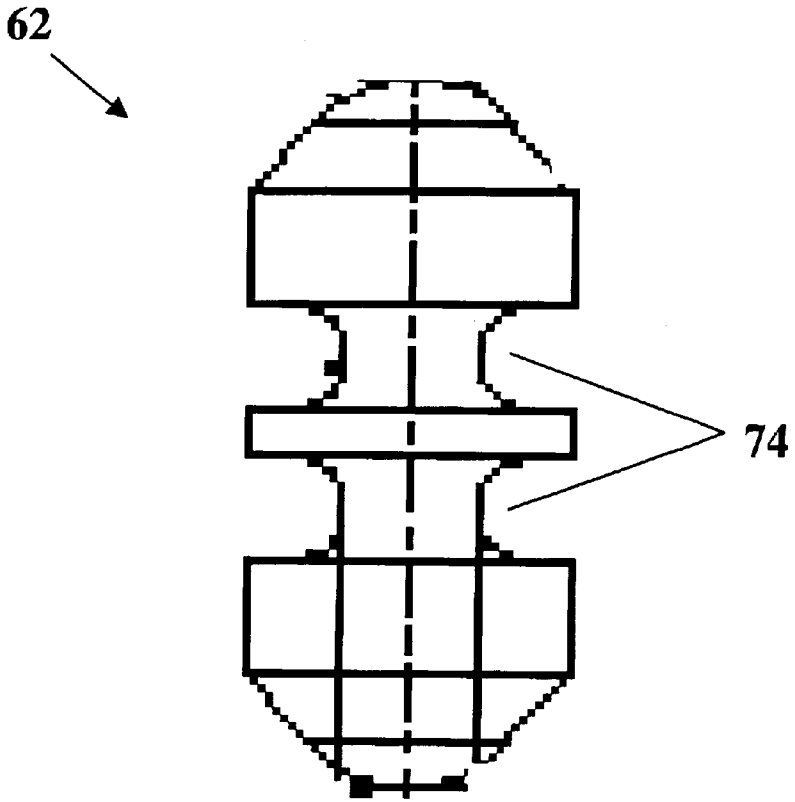
FIG. 9 is a cross-sectional view of an embodiment of an electrical contact in accordance with an embodiment of the present invention.

FIG. 9 is a cross-sectional view of an electrical contact 62. The electrical connector 62 is configured to include circumferentially recessed regions 74. When the electrical contact 62 is positioned within the base portion 70, the elastomer material of the base portion 70 is in contact with the surface of the circumferentially recessed regions 74. This configuration facilitates retention of the electrical contacts 62 within the base portion 70 of the electrical connector 26. This configuration also prevents water from penetrating through the base portion 70 along the surface of the electrical contact 62, thus providing a watertight seal between the back and front side of the electrical connector 26. Furthermore, the elastic properties of the material used to form the base portion 70 in conjunction with the shape of the electrical contacts 62, allows each electrical contact 62 to move independently. This independent movement facilitates the retention of the electrical coupling between the electrical contacts 62 and the flexible cable 35 while the connector assembly 100 is subject to various types of kinetic energy, such as vibration and handling the connector assembly 100 (e.g., using the connector assembly 100 as a handle to carry the handheld radio and powerblock assembly).

A connector assembly as described herein provides a low profile, watertight cable assembly that is capable of withstanding harsh environments to the point of meeting MIL-SPEC standards. The coupling between the electrical contacts 62 and the flexible cable 35 is a result of a pressure contact. No soldering is required to form electrical connections. The compression pad 44 absorbs vibration and other types of kinetic energy, thus allowing the electrical contacts 62 to move while electrical contact is maintained between the electrical contacts 62 and the flexible cable 35. The electrical connector 26 provides watertight integrity via the shape (e.g., hourglass cross section) of the electrical contacts 62 and the conformably shaped elastomer material in the base portion 70 of the electrical connector 26. Furthermore, the shape of the electrical contacts 62 in conjunction with the shape of the base portion 70 (e.g., raised portion 66) allow independent movement of each electrical contact 62 and prevents the electrical contacts 62 from electrically shorting to each other or to the back cover 14.

Although illustrated and described herein with reference to certain specific embodiments, the watertight connector assembly and apparatus as described herein is nevertheless not intended to be limited to the details shown. Rather, various modifications may be made in the details within the scope and range of equivalents of the claims and without departing from the spirit of the invention.

What is claimed is:

1. A flexible watertight connector assembly comprising:

a flexible cable encased in an elastomer coating defining a plurality of openings, each opening configured to provide access to said cable;

at least one electrical connector, each one of said at least one electrical connector positioned adjacent said cable within a respective one of said plurality of openings, each electrical connector configured to be electrically coupled to said cable; and at least one pair of covers comprising a first type cover and a second type cover, each cover positioned adjacent a respective one of said plurality of openings, each cover configured to form a watertight seal with said elastomer coating defining a respective opening, wherein:

each first type cover is configured to cover an opening having an electrical connector positioned therein; and each first type cover and a respective electrical connector are configured to form a watertight seal.

2. A connector assembly in accordance with claim 1, further comprising:

at least one compression pad positioned adjacent an opposite side of said cable having a respective electrical connector positioned adjacent thereto, and positioned between said cable and a respective second type cover.

3. A connector assembly in accordance with claim 2, each compression pad comprising a compression pad raised edge formed on a perimeter of said compression pad, wherein:

said compression pad raised edge is configured to form a watertight seal with said cable and a respective second type cover.

4. A connector assembly in accordance with claim 1, said elastomer coating comprising:

a plurality of coating raised edges, each one of said plurality of coating raised edges surrounding a respective one of said plurality of openings, wherein:

each coating raised edge defines each respective opening; and each coating raised edge is configured to form a watertight seal with each respective cover.

5. A connector assembly in accordance with claim 4, further comprising:

a plurality of strain reliefs positioned within each of said plurality of openings adjacent said plurality of coating raised edges.

6. A connector assembly in accordance with claim 1, further comprising a plurality of external device fasteners for fastening said assembly to an external device, wherein:

fastening openings for receiving a respective external device fastener are defined by respective covers, by a respective electrical connector, and by a respective portion of said cable within a respective access opening; and said fastening openings are aligned to receive said respective fastener when said connector assembly is assembled.

7. A connector assembly in accordance claim 6, wherein:

said fastener is a threaded fastener; and at least one of said fastener openings comprises threads for receiving said threaded fastener.

8. A connector assembly in accordance claim 1, each first type cover defining at least one cover access opening, each electrical connector comprising:

a molded elastomer base;

a plurality of electrically conductive contacts positioned within at least one raised portion of said base, said plurality of contacts configured to be electrically coupled to said cable, wherein:

each raised portion is configured to conformably mate with a respective cover access opening in a respective first type cover; and a raised edge formed on a perimeter of said base is configured to form a watertight seal with said cable and a respective first type cover.

9. A connector assembly in accordance with claim 8, each electrical contact comprising at least one indentation formed around a circumference of said electrical contact, wherein a surface of each indentation and said molded elastomer base form a watertight seal.

10. A connector assembly in accordance with claim 1, further comprising:

at least one elastomer seal configured to provide a watertight seal when said connector assembly is coupled to an external device, each of said at least one elastomer seal positioned on a perimeter of each respective first type cover.

11. A connector assembly in accordance with claim 1, wherein each first type cover comprises at least one guide pin for aligning said first type cover with an external device.

12. A connector assembly in accordance with claim 1, further comprising at least one assembly fastener for assembling said connector assembly.

13. A connector assembly in accordance with claim 12, said assembly fastener further comprising a recessed portion adjacent a head of said assembly fastener, said recessed portion adjacent said head configured to receive an assembly fastener seal for forming a watertight seal between said assembly fastener and a respective second type cover.

* * * * *